US005141468A

United States Patent [19]

Suzuki

[11] Patent Number: 5,141,468

[45] Date of Patent: Aug. 25, 1992

[54] TRAVELLING TOY HAVING A LAUNCHER

[75] Inventor: Toshio Suzuki, Tokyo, Japan

[73] Assignee: Toybox Corporation, Tokyo, Japan

[21] Appl. No.: 643,288

[22] Filed: Jan. 22, 1991

[30] Foreign Application Priority Data

Jan. 23, 1990 [JP] Japan ..... 2-4829

[51] Int. Cl.[5] ..... A63H 17/26

[52] U.S. Cl. ..... 446/435; 446/431; 446/26

[58] Field of Search ..... 446/26, 28, 73, 431, 446/435, 441, 444, 448, 449, 457, 464, 465

[56] References Cited

U.S. PATENT DOCUMENTS 4,373,290 2/1983 Goldfarb et al. ..... 446/462 X
4,413,443 11/1983 Kulesza et al. ..... 446/26
4,423,871 1/1984 Mucaro ..... 446/444 X
4,443,967 4/1984 Jones et al. ..... 446/462
4,501,567 2/1985 Cathell ..... 446/462 X
4,529,389 7/1985 Kennedy et al. ..... 446/26
4,541,813 9/1985 Ikeda ..... 446/444 X
4,555,237 11/1985 Nikaido ..... 446/462 X
4,715,602 12/1987 May et al. ..... 446/462 X

FOREIGN PATENT DOCUMENTS 2136702 9/1984 United Kingdom .

*Primary Examiner*—Robert A. Hafer
*Assistant Examiner*—Sam Rimell
*Attorney, Agent, or Firm*—Staas & Halsey

[57] ABSTRACT

A travelling toy having a ramp member to which a toy vehicle is selectively secured, and a base member pivotally secured to the ramp member. The base member is pivotable back and forth between two positions. A ratchet device converts the two-directional pivotal motion of the base member relative to the ramp member into one-directional rotational motion of a flywheel within the toy vehicle. A releasing device selectively releases the toy vehicle from the ramp member after the driving force has been accumulated in the flywheel.

12 Claims, 2 Drawing Sheets

TRAVELLING TOY HAVING A LAUNCHER

BACKGROUND OF THE INVENTION

1. Field of the Invention

This invention relates to a travelling toy, and more particularly to a travelling toy having a launcher that generates and transfers driving force to a toy vehicle.

2. Description of the Related Art

Toy vehicles are well known in the art, and generally include a flywheel drive mechanism connected through a driving axle to at least one driving wheel. Driving force is accumulated in the flywheel drive mechanism for transfer to the driving wheel. The toy vehicle is then driven upon a driving surface through frictional contact between the driving wheel and the driving surface. Two types of prior art devices are used to accumulate driving force in the flywheel drive mechanism of toy vehicles.

One type of prior art device that is used to accumulate driving force in the flywheel drive mechanism of toy vehicles includes a manual flywheel. Driving force is accumulated in the flywheel drive mechanism of the toy vehicle by bringing the driving wheel of the toy vehicle into pressure contact with the manual flywheel. However, the manual flywheel device has several disadvantages. For example, the manual flywheel device is large and cumbersome Also, the manual flywheel device is difficult to use because the body of the toy vehicle must be held down so that the driving wheel is maintained in pressure contact with the manual flywheel. Consequently, two-handed operation is required.

Another type of prior art device used to accumulate driving force in the flywheel drive mechanism of toy vehicles is a long rack belt. The long rack belt is brought into mesh with a driving gear mounted on the driving wheel of the toy vehicle, and then is pulled quickly to accumulate driving force in the flywheel drive mechanism of the toy vehicle. Consequently, two-handed operation is required. Also, the long rack belt is only suitable for a two-wheeled toy vehicle or the like in which the driving wheels and the driving gear are exposed to the exterior of the toy vehicle. The long rack belt cannot be used with a four-wheeled toy vehicle or the like in which a driving gear cannot be exposed to the exterior of the body of the toy vehicle. That is, because the driving wheel of a four-wheeled toy vehicle does not project from the vehicle body, the driving gear cannot be exposed so as to be brought into mesh with the long rack belt. In addition, a four-wheeled toy vehicle has no space for insertion of the long rack belt.

SUMMARY OF THE INVENTION

It is an object of the present invention to provide a travelling toy that includes a driving force accumulating device that is small and easy to use.

Another object of the present invention is to provide a travelling toy having a driving force accumulating device that does not require two-handed operation.

In order to achieve the foregoing and other objects, in accordance with the purposes of the present invention as described herein, a travelling toy having a launcher and a toy vehicle with a flywheel, comprises: a ramp member having an opening; a base member pivotally connected to the ramp member about a pivot shaft; a rack piece mounted on the base member; a first gear rotatably secured to the ramp member so as to be engageable from the opening; transmission gears in mesh with one another and rotatably secured to the ramp member, one of said transmission gears being in mesh with the rack piece and other of the transmission gears being selectively in mesh with the first gear; a transfer gear rotatably secured to the toy vehicle and in mesh with the flywheel of the toy vehicle; and a driving gear in mesh with the transfer gear and rotatably secured to the toy vehicle, the driving gear being engageable with the first gear.

These and other features and advantages of the present invention will become more apparent with reference to the following detailed description and drawings. However, the drawings and description are merely illustrative in nature and not restrictive.

BRIEF DESCRIPTION OF THE DRAWINGS

The accompanying drawings illustrate several aspects of the present invention, and together with the description serve to explain the principles of the present invention. In the drawings.

DETAILED DESCRIPTION OF THE PREFERRED EMBODIMENTS

Figure 1:
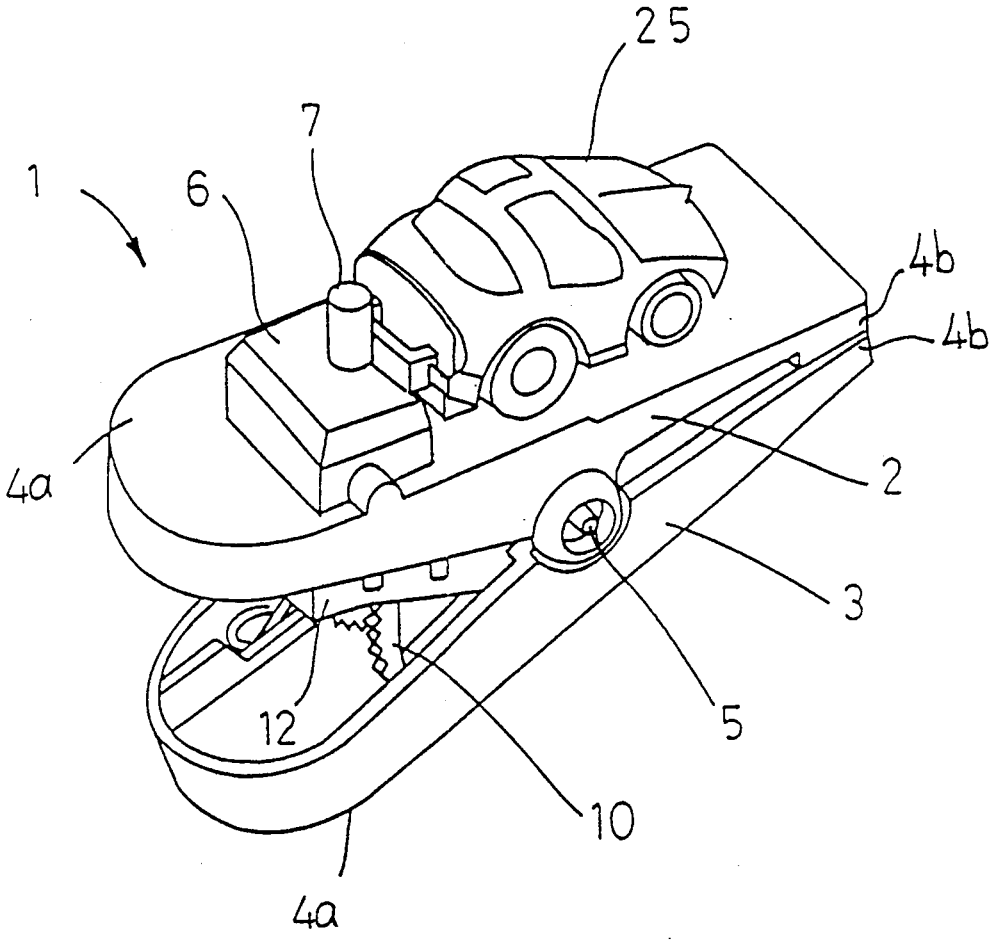
FIG. 1 is a perspective view of an embodiment of a travelling toy according to the present invention.

FIG. 1 is a perspective view of an embodiment of a travelling toy according to the present invention. Launcher 1 includes a ramp member 2 and a base member 3. Ramp member 2 and base member 3 include a grip portion **4*a* and a nipping portion 4*b*, and are pivotally connected at a central portion by a pivot shaft 5 and shaped so as to form a clip. A box-shaped launch tower 6 is included on the outside surface of ramp member 2. A release button 7 projects from the upper surface (as shown in FIG. 1) of launch tower 6**.

Figure 2:
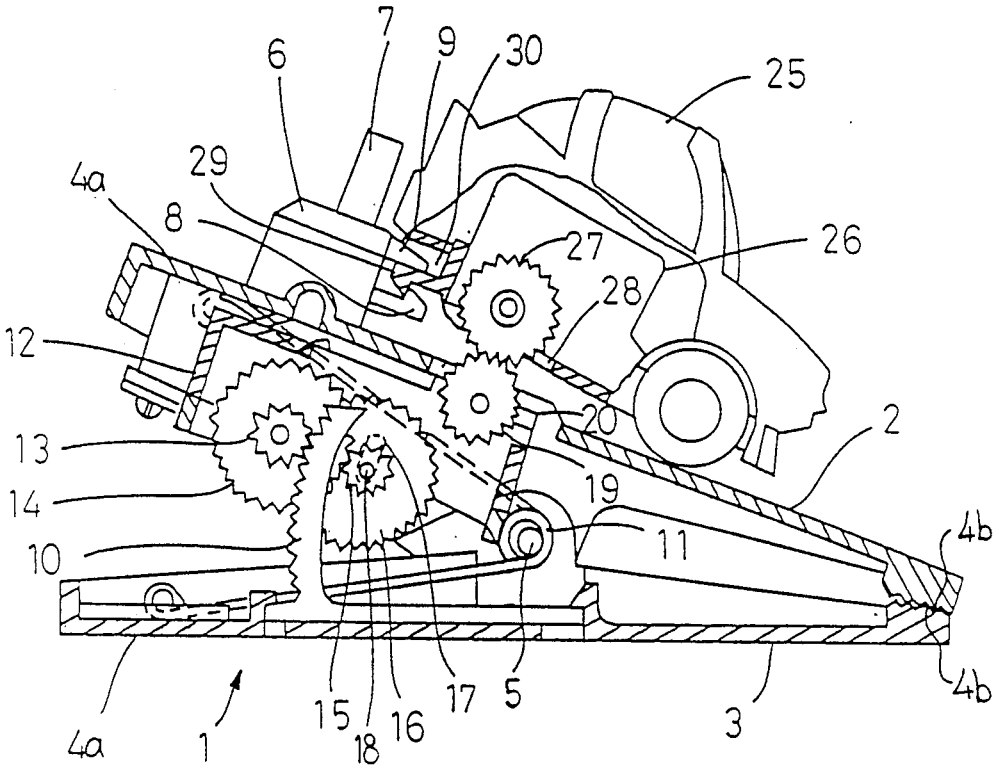
FIG. 2 is a partially cut-away sectional view of the embodiment shown in FIG. 1 and shows the toy vehicle retained by the launcher.

FIG. 2 is a partially cut-away sectional view of the embodiment shown in FIG. 1 and shows a toy vehicle 25 retained by launcher 1.

A rack piece 10 is mounted on the inner surface of base member 3 and forms an arc centered about pivot shaft 5. Alternatively, rack piece 10 may be a generally straight rack pivotally mounted on the inner surface of bar member 3 and biased into mesh. A torsion spring 11 is wound around pivot shaft 5, with the ends of torsion spring 11 respectively contacting the inside surface of ramp member 2 and the inside surface of base member 3. Torsion spring 11 biases grip portions **4*a* away from one another, while biasing nipping portions 4*b* into contact with one another. Alternatively, torsion spring 11 may be a coil spring, a leaf spring or the like. When grip portions 4*a* are pressed toward one another against the bias of torsion spring 11, nipping portions 4*b* are brought out of contact with one another. The player may use nipping portions 4*b* to clip launcher 1 to a pocket in his or her clothes, or to papers and the like. Alternatively, the nipping portion 4*b* of base member 3** may be omitted.

A gear housing 12 is included on the inside of ramp member 2, and rotatively mounts a pinion 13, a gear 14, a pinion 15, a gear 16 and a gear 19. Gear 14 and pinion 13 are coaxial and integrally formed, as are pinion 15 and gear 16. Alternatively, gear 14 and pinion 13 may be coaxial and separately formed, as may pinion 15 and gear 16.

Rack piece 10 is normally in mesh with pinion 13, consequently, pinion 13 and gear 14 rotate in the counterclockwise and clockwise directions (relative to the perspective shown in FIG. 2) as grip portions 4a are respectively brought toward each other and released. Gear housing 12 includes a bearing hole 17 which is elongated and which retains a gear shaft 18 on which pinion 15 and gear 16 are mounted. Pinion 15 meshes with gear 14, and consequently pinion 15 and gear 16 rotate in the clockwise and counterclockwise directions (relative to the perspective shown in FIG. 2) as grip portions 4a are respectively brought toward each other and released. Bearing hole 17 is elongated in a vertical direction (as shown in FIG. 2) so that when grip portions 4a are brought toward each other, gear shaft 18 moves from the lower end (as shown in FIG. 2) of bearing hole 17 to the upper end of bearing hole 17 and into mesh with gear 19, thereby causing gear 19 to rotate counterclockwise (relative to the perspective in FIG. 2).

On the other hand, when grip portions 4a are released after having been brought toward one another, gear 16 moves down bearing hole 17 away from gear 19, so that only counterclockwise rotation is transmitted to gear 19. Therefore, gear 19 forms a ratchet with gear 16 and is adapted to rotate in one direction through engagement and disengagement with gear 16 because of the motion of gear 16 within bearing hole 17. By repeatedly bringing grip portions 4a toward each other and releasing, gear 19 can rotate counterclockwise continuously. An opening 20 is formed in ramp member 2, and gear 19 is mounted in gear housing 12 so as to project upward from opening 20.

Figure 3:
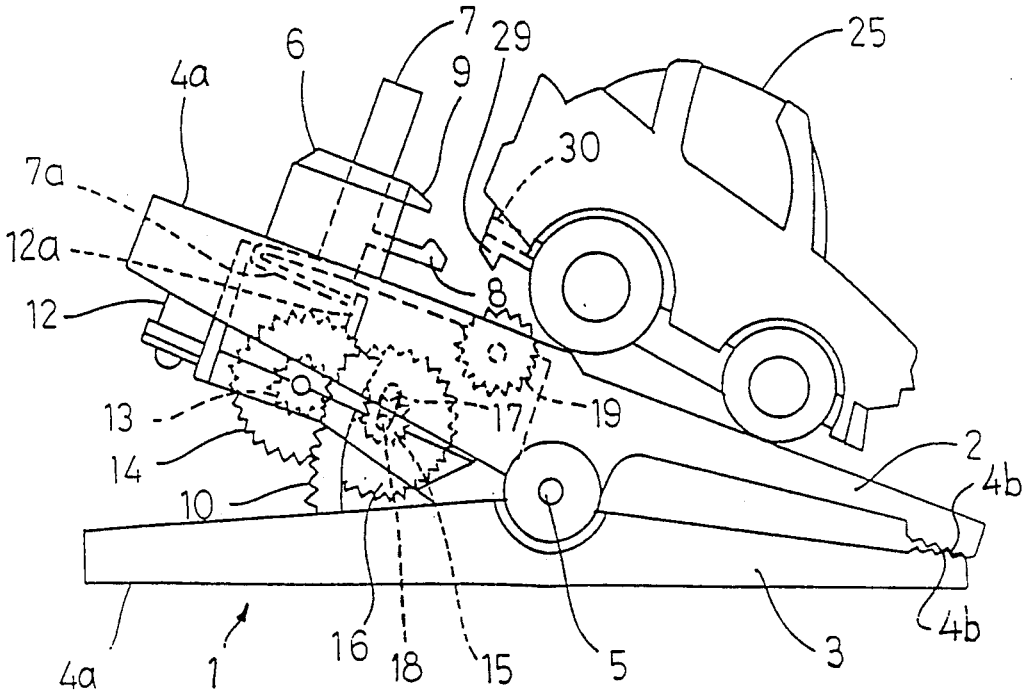
FIG. 3 is a perspective view of the embodiment shown in FIG. 1 and shows the toy vehicle released from the launch tower.

FIG. 3 is a perspective view of the embodiment shown in FIG. 1 and shows toy vehicle 25 released from launch tower 6.

Push button 7 projects from launch tower 6 and includes a retaining tang 8. Push button 7 also includes a generally V-shaped elastic piece 7a (phantom line in FIG. 3), the lower end of which abuts with a lug 12a of gear housing 12. Alternatively, push button 7, retaining tang 8 and V-shaped elastic piece 7a may be separate pieces, rather than having a one piece construction. Also, V-shaped elastic piece 7a may be a coil spring, a torsion spring or the like. A stop piece 9 projects from launch tower 6 in a position above (as shown in FIG. 3) retaining piece 8.

Toy vehicle 25 includes a fitting hole 30 into which stop piece 9 is inserted, and a retaining tang 29 which is brought into engagement with retaining tang 8. Toy vehicle 25 also includes rear driving wheels, a driving axle, and driving gear 27. A flywheel drive mechanism 26 of known structure is rotatably connected to driving gear 27 through a transfer gear (not shown). Gear 27 projects downwardly from the underside of toy vehicle 25 and is in mesh with gear 19 when toy vehicle 25 is attached to launch tower 6.

As shown in FIG. 2, retaining tang 29 is sandwiched between stop piece 9 and retaining tang 8, and gear 27 is in mesh with gear 19. Alternatively, gear 27 may be flush with the underside of toy vehicle 25, with gear 19 projecting into engagement with gear 27. Although not shown in FIG. 2, the rear driving wheels of toy vehicle 25 are not in contact with the surface of ramp member 2 when toy vehicle 25 is attached to launch tower 6, and thus the rear driving wheels are free to rotate.

With toy vehicle 25 attached to launch tower 6, grip portions 4a are repeatedly forced toward each other and then released. Consequently, driving gear 27 is rotated by gear 19 and a flywheel (not shown) within flywheel drive mechanism 26 rotates at high speed to accumulate driving force. Then, upon depression of release button 7, retaining tang 8 moves down and is disengaged from retaining tang 29, and toy vehicle 25 rolls down ramp member 2 until the rear driving wheels contact the surface of ramp member 2. Once the driving wheels of toy vehicle 25 contact the surface of ramp member 2, the driving force accumulated in the flywheel drive mechanism drives toy vehicle 25 down the ramp member and onto a driving surface (not shown).

All of the operations required, e.g., squeezing and releasing grip portions 4a toward each other and pushing release button 7, can be accomplished with the use of one hand. Thus, the travelling toy of the present invention is easy to operate.

Numerous modifications and adaptations of the present invention will be apparent to those so skilled in the art and thus, it is intended by the following claims to cover all modifications and adaptations which fall within the true spirit and scope of the present invention.

What is claimed is:

1. A travelling toy having a launcher and a toy vehicle with a flywheel, comprising:
   - a ramp member;
   - a base member pivotally connected to said ramp member about a pivot shaft;
   - a rack piece mounted on said base member;
   - a first gear rotatably secured to said ramp member;
   - transmission gears in mesh with one another and rotatably secured to said ramp member, one of said transmission gears being in mesh with said rack piece and another of said transmission gears being selectively in mesh with said first gear; and
   - a driving gear in mesh with the flywheel of the toy vehicle and rotatably secured to the toy vehicle, said driving gear being engageable with said first gear.

2. A travelling toy as recited in claim 1, wherein:
   said ramp member and said base member each include a grip portion, a central portion and a nipping portion, and said pivot shaft pivotally connects the central portions of said ramp member and said base member so that said grip portions of said ramp member and said base member pivot toward and away from one another while said nipping portions of said ramp member and said base member pivot away and toward one another, respectively.

3. A travelling toy as recited in claim 2, wherein:
   said nipping portions of said ramp member and said base member are biased toward one another with a spring.

4. A travelling toy as recited in claim 1, wherein:
   said rack piece is arcuate and centered about said pivot shaft.

5. A travelling toy as recited in claim 1, wherein:
   said first gear projects from a hole in said ramp member.

6. A travelling toy as recited in claim 1, further comprising:
   - a driving wheel rotatably connected to said driving gear.

7. A travelling toy as recited in claim 6, further comprising:

a first retaining tang mounted on the toy vehicle;

a second retaining tang movably mounted on said ramp member so as to selectively engage and disengage said first retaining tang.

8. A travelling toy as recited in claim 7, wherein:

said first gear is engaged with said driving gear and said driving wheel is not in contact with said ramp member when said second retaining tang is engaged with said first retaining tang.

9. A travelling toy as recited in claim 7, wherein:

said second retaining tang is biased into engagement with said first retaining tang by a spring.

10. A travelling toy as recited in claim 9, further comprising:

a release button operatively associated with said second retaining tang so as to selectively move said second retaining tang out of engagement with said first retaining tang against the bias of said spring.

11. A travelling toy as recited in claim 1, wherein:

said first gear rotates in only one direction.

12. A travelling toy having a launcher and a toy vehicle with a flywheel, comprising:

a ramp member, the toy vehicle being selectively secured to said ramp member, and said ramp member including a grip portion, a central portion and a nipping portion;

a base member pivotally connected to said ramp member about a pivot shaft, said base member including a grip portion, a central portion and a nipping portion, wherein said pivot shaft pivotally connects the central portions of said ramp member and said base member, and wherein the nipping portions of said ramp member and said base member are biased toward one another with a spring so as to nippingly engage one another;

means for transforming pivotal motion of said base member relative to said ramp member to rotational motion of the flywheel; and means for selectively releasing said toy vehicle from said ramp member.

* * * * *